US006356039B2

(12) United States Patent
Huot et al.

(10) Patent No.: US 6,356,039 B2
(45) Date of Patent: Mar. 12, 2002

(54) MODULAR ELECTRONIC SUPPLY DEVICE FOR DISCHARGE LAMP

(75) Inventors: Laurent Huot, La Tour de Salvagny; Philippe Escaich, Lyons, both of (FR)

(73) Assignee: Bureau d'Etudes Eclairage Public - B.E.E.P., Les Cheres (FR)

( * ) Notice: Subject to any disclaimer, the term of this patent is extended or adjusted under 35 U.S.C. 154(b) by 0 days.

(21) Appl. No.: 09/769,265

(22) Filed: Jan. 26, 2001

(30) Foreign Application Priority Data

Jan. 27, 2000 (FR) ..... 00 01068

(51) Int. Cl.[7] ..... G05F 1/00

(52) U.S. Cl. ..... 315/291; 315/209 R; 315/160; 315/312; 315/DIG. 7

(58) Field of Search ..... 315/164, 160, 315/177, 200 R, 209 R, 220, 226, 291, 224, 277, DIG. 7, 312, 317

(56) References Cited

U.S. PATENT DOCUMENTS

| | | | | |
|---|---|---|---|---|
| 4,441,055 A | * | 4/1984 | Balchjunas et al. | 315/288 |
| 4,751,398 A | | 6/1988 | Ertz, III | 315/86 |
| 5,654,609 A | | 8/1997 | Smallwood et al. | 315/56 |
| 5,808,450 A | * | 9/1998 | Chula et al. | 315/160 X |
| 5,877,596 A | | 3/1999 | Allison | 315/308 |
| 6,307,757 B1 | * | 10/2001 | Porter et al. | 363/21.01 |

FOREIGN PATENT DOCUMENTS

| | | |
|---|---|---|
| DE | 19521087 | 12/1996 |
| EP | 0669787 | 8/1995 |
| FR | 2663184 | 12/1991 |
| FR | 2665032 | 1/1992 |
| FR | 2734118 | 11/1996 |
| WO | 9427419 | 11/1994 |
| WO | 9722232 | 6/1997 |

* cited by examiner

*Primary Examiner*—Haissa Philogene
(74) *Attorney, Agent, or Firm*—Dowell & Dowell, P.C.

(57) ABSTRACT

This invention relates to a supply device for discharge lamps, which comprises, for each lamp:

a first module or current injection circuit comprising, inter alia, a high-frequency inverter delivering a current adapted to ensure stabilization of the discharge in the lamp, a high-frequency transformer providing galvanic insulation of this current with respect to a supply network, then a rectifier and a filter adapted to produce a direct current, a second module or starter-converter circuit, installed near the lamp and adapted to generate, by periodic inversions of the sign of the direct current at the output of the first module or current injection circuit, an alternating current in square-wave form for supplying the lamp, and a bifilar electrical connection between the first module and the second module.

9 Claims, 2 Drawing Sheets

MODULAR ELECTRONIC SUPPLY DEVICE FOR DISCHARGE LAMP

FIELD OF THE INVENTION

The present invention relates to a modular electronic supply device for a discharge lamp that may be used in particular for an outside lighting system or a system for illuminating an industrial building.

BACKGROUND OF THE INVENTION

In the field of outside lighting, it is known, for example from EP-A-0 933 979, to use an electronic supply device, sometimes called "electronic ballast", for an arc lamp such as a fluorescent tube, a sodium vapour lamp, a metal halid lamp or an equivalent lamp. In the known systems, the ballast is generally arranged either in the luminaire or at the foot of a public lamp post. In this latter case, a conductor cable connects the ballast and its peripherals to the lamp, over the height of the lamp post which is generally between 5 and 20 meters. The starting voltage of a discharge lamp being of the order of 4000 volts, the electrical supply line of the lamp over the height of the lamp post must be able to resist such a voltage and its section must be provided to be relatively large. At the present time, there exist two large families of electronic ballasts: those which directly supply the lamp with high-frequency current, generally several tens of kilohertz, and those which supply the lamp with a so-called square-wave current. The ballasts belonging to the second square-wave family deliver a current whose frequency is generally of some hundreds of hertz. The inductance of the cable connecting the ballast to the lamp creates an impedance proportional to the frequency of the current that it conveys and this impedance may significantly affect the performances of the ballast, in particular in the case of high-frequency supply. On the other hand, the impedance of the cable considerably attenuates the starting pulse delivered by the ballast when the lamp is lit. These phenomena make it necessary to reduce the distance between the ballast and the lamp. It is not always possible to install the ballast in height in the lamp post due to the question of space requirement. Moreover, if a ballast presenting an insulation transformer were used, the lower part of the lamp post would in that case be traversed by the mains current, which would cancel the safety procured by the galvanic insulation.

Furthermore, systems for regulating groups of discharge lamps exist, in which the supply voltage of all the lamps is varied, this voltage being able to be D.C. These systems do not allow an individualized control of the lamps and/or the connection of temporary accessories or material, as the network conveys a variable D.C. voltage incompatible with the majority of this material. These known systems in which control is effected in voltage, render the use of a ballast downstream of the D.C. supply line necessary.

Similar limitations exist with the known system of U.S. Pat. No. 4,751,398 in which ballasts are mounted downstream of a single common supply, these ballasts having to generate the supply current of a lamp and be dedicated to that lamp.

The problems set forth hereinabove are also encountered in the systems for illuminating industrial buildings in which the supply devices must be grouped together near the lamps, in particular in the upper part of the superstructure of a hall.

It is a more particular object of the invention to overcome these drawbacks by proposing a supply device with galvanic insulation which may be used with different types of individually controlled discharge lamps, in particular lamps functioning with high-pressure sodium vapour and metal iodide lamps, and whose space requirement is adapted to its environment.

SUMMARY OF THE INVENTION

To that end, the invention relates to a supply device for discharge lamps, characterized in that it comprises, for each lamp:

- a first module or current injection circuit comprising, inter alia, a high-frequency inverter delivering a current adapted to ensure stabilization of the discharge in the lamp, a high-frequency transformer providing galvanic insulation of this current with respect to a supply network, then a rectifier and a filter adapted to produce a direct current at the output of this module,
- a second module or starter-converter circuit, installed near the lamp and adapted to generate, by periodic inversions of the sign of the direct current at the output of the first module or current injection circuit, an alternating current in square-wave form for supplying the lamp, and
- a bifilar electrical link between the first module and the second module.

The modular nature of the device of the invention makes it possible to install the second module in the immediate proximity of the lamp, for example in the lantern of a lamp post or in a cable trough or path of an industrial hall, while the current injection module may be installed at a considerable distance, the length of the D.C. supply line not being a hindrance since its impedance does not interfere with the performances of the device. In practice, this line may present a length of several hundreds of meters without this length significantly affecting the performances of the system. The fact that the first module constitutes an insulated source of current, in particular from the mains voltage at 50 or 60 Hz, makes it possible to render secure the different elements located downstream of this first module and, in particular the supply line, which, to a wide extent, eliminates the risks of electrocution associated with this type of equipment. The nature of current source of the first module enables it to perform the role of a ballast for the lamp that it supplies, thanks to the inversion of current obtained by the second module. In this way, it is unnecessary to provide a ballast in the proximity of each lamp. The current transiting in this D.C. supply line may be relatively weak, of the order of some amps, at a voltage of the order of some hundreds of volts. For these reasons, this line does not require particular precautions as to its insulation with respect to its environment.

According to advantageous but non-obligatory aspects of the invention, the device incorporates one or more of the following characteristics:

- The second module or starter-converter circuit is compatible with lamps of different powers or of different types, while the first module or injection circuit is dedicated to a given power of lamps, the lamps being able to be of different types for a given power. The second module may therefore be mass-produced and installed by default in the lanterns of certain lamp posts or in the floodlights of certain industrial hall lamps, before the lamp is placed in position, the final choice of the lamp making it possible to associate a first module as a function of the exact type of the lamp.
- The device comprises a third module or control circuit adapted to transmit information, particularly orders to start, to stop or to reduce power, to the first module or current injection circuit, as a function of instructions furnished by an outside system, while the exchange of information between the first and third modules takes place via a wireless, for example infra-red, link, in order to guarantee the galvanic insulation between these modules. The third module makes it possible to manage the possibly progressive start up, variation of power and interruption of the functioning of the lamp. This third module in fact makes it possible to transmit to the first module all types of instructions furnished by an outside system such as a system for remote-management of the lighting. This third module may be provided to receive information from the first module or current injection circuit concerning the functioning of the lamp and/or the modules and to transmit it to the outside system, which allows a return of information to that system. According to variant embodiments, the third module may be specific for one first module or injection circuit or associated with a plurality of first modules or injection circuits.

The first module or injection circuit comprises, inter alia, a first rectifier of the mains current supplying the high-frequency inverter associated with a power factor corrector and supplying the high-frequency inverter.

The second module or starter-converter circuit comprises four power transistors in a full bridge configuration and associated with an electronic control unit for starting and supplying the lamp with alternating current.

The second module or starter-converter circuit comprises a high-voltage transformer intended for starting the lamp.

In the case of a public lighting system comprising lamp posts, the lamp and the second module are installed in or in the immediate proximity of the lantern of the lamp post, while the first module is installed at the foot of this lamp post. In the case of an interior lighting system, the lamp may be installed in a deflector close to the ceiling of a building, the second module being housed in the vicinity of this deflector, in particular in a trough or path for cables supplying this lamp, while the first module is installed at ground level, in an easily accessible place.

BRIEF DESCRIPTION OF THE DRAWINGS

The invention will be more readily understood and other advantages thereof will appear more clearly on reading the following description of two embodiments of a supply device in accordance with its principle, given solely by way of example and made with reference to the accompanying drawings, in which.

DESCRIPTION OF PREFERRED EMBODIMENTS

Figure 1:
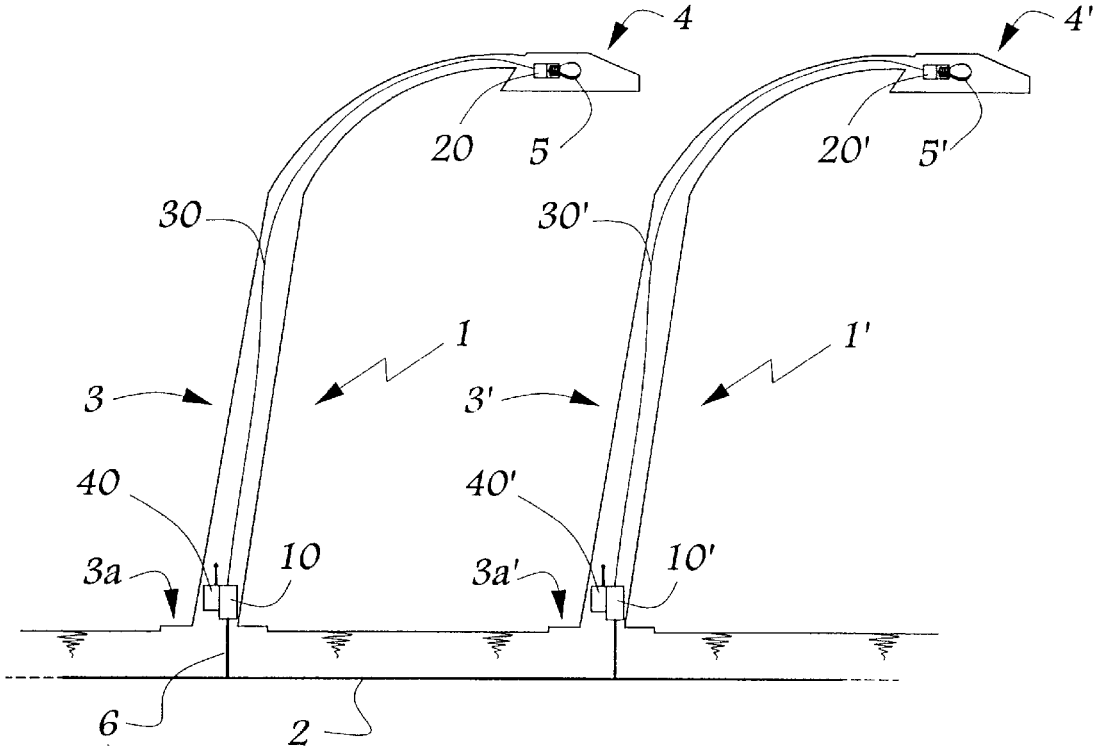
FIG. 1 schematically shows a public lighting installation incorporating supply devices according to the invention.

Referring now to the drawings, the public lighting installation shown in FIG. 1 comprises lamp posts 1 and 1' supplied with electric current from a low voltage network 2 conveying alternating current of frequency equal to 50 or 60 hertz. Each lamp post 1, 1' is composed respectively of a post 3, 3' and a lantern 4, 4' inside which is arranged a discharge lamp 5, 5', for example a metal iodide lamp.

According to the invention, the device supplying the lamp 5 comprises a first module 10 disposed in the foot zone 3*a* of the post 3 and connected to the network 2 by a cable 6.

The device also comprises a second module 20 forming "starter-converter" or "starter reverser" circuit for the lamp 5 and disposed in the immediate proximity of this lamp in the lantern 4. A bifilar supply line 30 extends over the height of the post 3 and allows the output of the first module 10 to be connected to the input of the second module 20.

Figure 2:
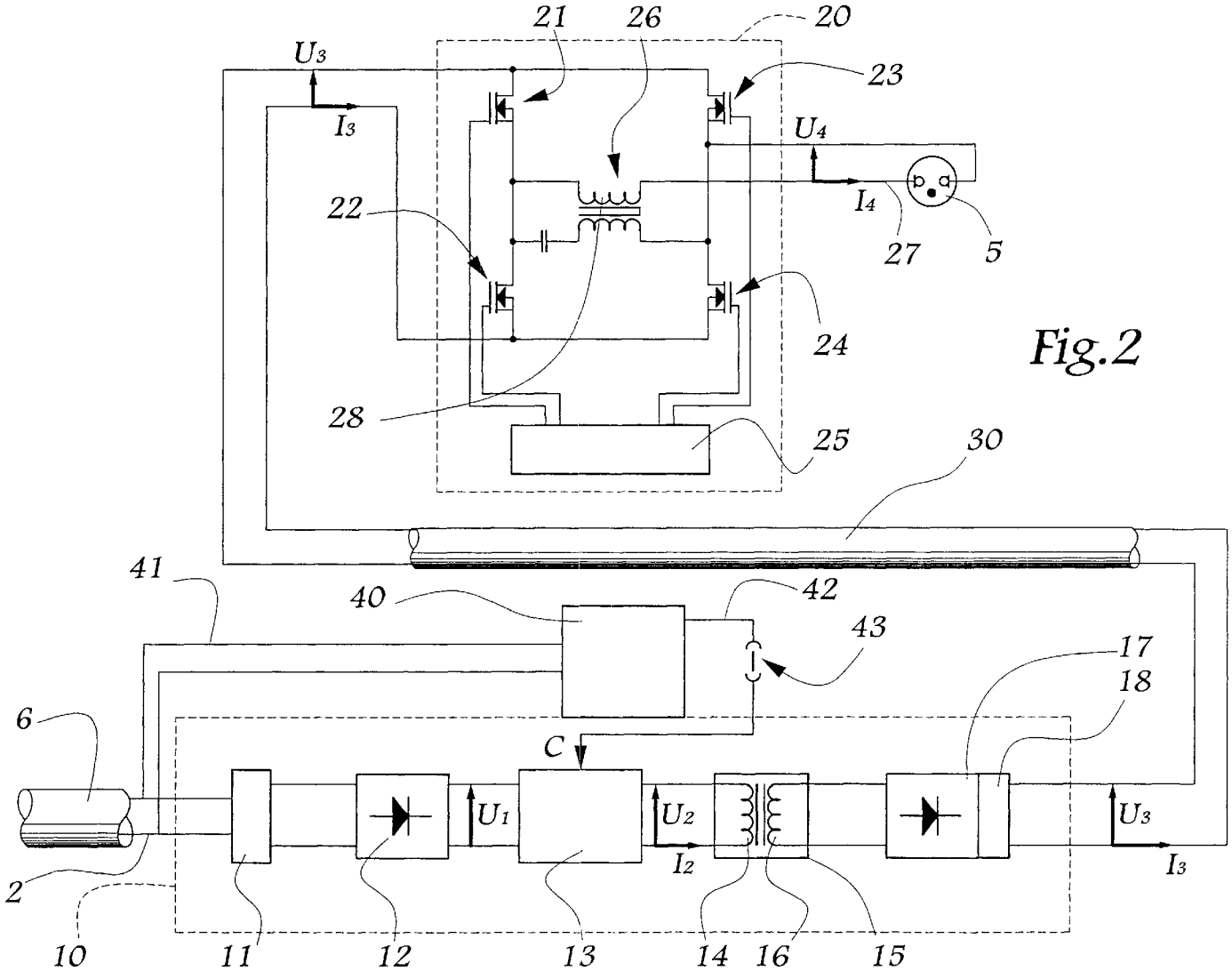
FIG. 2 is a diagram of a supply device used in the installation of FIG. 1, and FIG. 3 schematically shows an industrial lighting installation incorporating supply devices according to the invention.

As is more particularly visible in FIG. 2, the module 10 comprises, at the input, a filter 11 at the output of which is connected a rectifier 12 including a power factor corrector. Elements 11 and 12 are such that, when the module 10 is supplied, for example, by a voltage of about 230 volts at a frequency of about 50 hertz, the D.C. voltage $U_1$ at the output of the rectifier 12 is of the order of 400 volts. An inverter 13 of half-bridge type transforms the voltage $U_1$ into an A.C. voltage $U_2$ of amplitude equal to about 200 volts and of frequency equal to about 50 kilohertz. $I_2$ denotes the output current of the inverter 13. The inverter 13 is configured so that the current $I_2$ and the voltage $U_2$ are adapted to supply the lamp 5, this current and this voltage being able to be assimilated to ballast output current and voltage. In that sense, the current $I_2$ is adapted to ensure stabilization of the discharge in the tube of the lamp 5. The current $I_2$ and the voltage $U_2$ are supplied to the primary winding 14 of an insulation transformer 15 of which the secondary winding 16 is connected to a rectifier 17 incorporating a filter 18. The rectifier 17 generates a direct current $I_3$ of the order of some amps, the voltage $U_3$ depending on the load connected at the output of the module 10. The voltage $U_3$ is included between 0 and 350 volts, depending on the state of the lamp 5.

The inverter 13 is advantageously of the type known from EP-A-0 933 799.

The module 10 therefore functions as a current generator for the line 30 in which it injects current $I_3$.

A third module 40 is placed next to the first module 10 and constitutes a box for controlling this module as a function of orders emitted by a system managing the installation, these orders being transmitted by any appropriate means, for example by hertzian route or thanks to a carrier current system using the supply network 2.

The box or module 40 is supplied by a branch line 41 from the cable 6 and its output 42 is connected by an optical connector 43 to the module 10, which makes it possible to address to the inverter 13 a reference signal C controlling functioning of the module 10, in particular for start up, reduction of power or stop of the lamp 5, as a function of a timetable or of conditions of luminosity and respecting a certain progressivity for these phases of transition.

The module 20 comprises four switches 21, 22, 23 and 24 formed by power transistors in a full bridge configuration and making it possible to create, from the voltage $U_3$ and the current $I_3$ transiting via line 30, an A.C. voltage $U_4$ and current $I_4$, of frequency equal to about 100 hertz. More precisely, an electronic control unit 25 monitors the functioning of the four transistors 21 to 24, allowing, during starting of the lamp, a voltage pulse to be sent via a transformer 26 whose secondary winding 28 is connected to a conductor 27 for supplying the lamp 5. When the lamp is started, this unit 25 ensures commutation of the transistors 21 to 24 so as to obtain, at the output of the bridge, an A.C. voltage $U_4$, the value of this voltage determining the state of the system. In effect, the value of the voltage $U_4$ depends on the state of the lamp 5, the value of the voltage $U_3$ between the conductors of the line 30 varying with that of the voltage $U_4$. It was determined that the value of the voltage $U_4$ is of the order of 100 volts when the lamp 5 is hot, of the order of 20 volts when the lamp 5 is cold, and of the order of 350 volts when the lamp 5 is extinguished, burnt out or absent. The variable nature of the voltage $U_3$ is due to the fact that the module 10 functions as a generator of current $I_3$.

As the module 20 functions by periodic inversions of the sign of the direct current $I_3$, it generates the current $I_4$ and the voltage $U_4$ of square-wave form without modifying their root mean square values with respect to those of $I_3$ and of $U_3$.

The module 20 may be adapted to different lamp powers. For example, a type of module 20 may be compatible with lamps of power included between 50 and 150 watts, while another type of module 20 is compatible with the lamps of power included between 250 and 400 watts. The first type of module 20 is of small space requirement, which allows it to be integrated in lanterns 4 of relatively narrow dimensions, in relation with the size of the lamps 5 in question. The second type of module 20 may be of larger size since the lamps 5 and the lanterns 4 with which it is associated are of larger dimensions. In this way, in a production comprising two types of lanterns 4 adapted to two lamp power series, the starter-converter modules 20 may be pre-assembled in the lanterns 4 before the definitive choice has been made of the lamp 5 used.

As for the module 10, it is chosen as a function of the exact power of the lamp 5, so that the characteristics of the current generator which it constitutes are optimalized with respect to this power.

Similar modules 10', 20' and 40' are used in the second lamp post 1', with a line 30' connecting the modules 10' and 20', module 10' being housed in the foot 3'*a* of the post 3' while the module 20' is housed in lantern 4'.

In the embodiment of FIG. 1, module 40 is associated with each module 10, which allows a point-by-point control of a public lighting network.

According to a variant of the invention (not shown), a common control unit may be associated with a plurality of supply modules.

Figure 3:
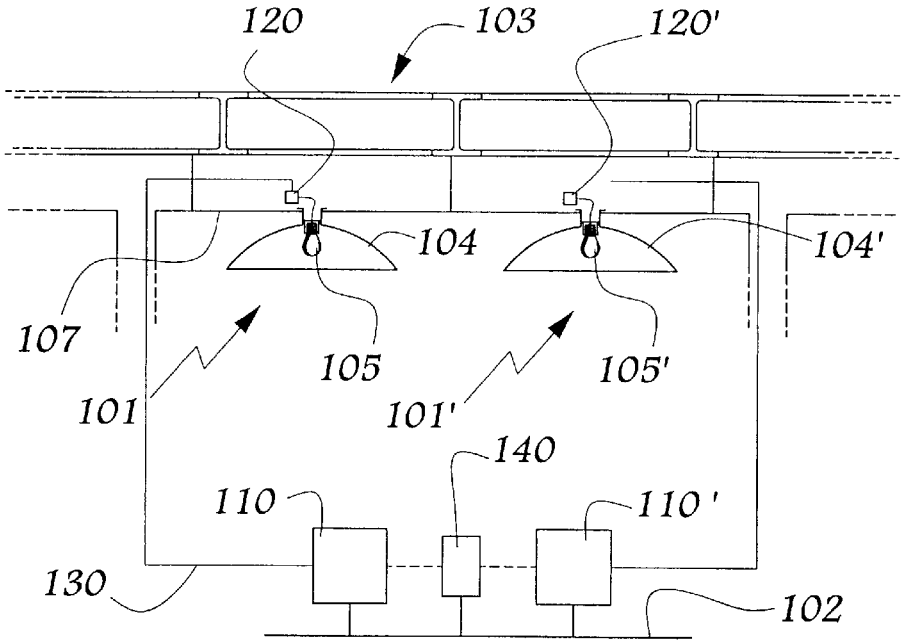

In the second embodiment of the invention as shown in FIG. 3, elements similar to those of the first embodiment bear identical references increased by 100. This embodiment concerns an installation for lighting an industrial hall comprising floodlights 101 and 101' supplied from the network 102 and supported by a frame structure 103. Each floodlight comprises a deflector 104 or 104' inside which a lamp 105 or 105' is housed.

According to the invention, the devices supplying the lamps 105 and 105' each comprise a first module 110 or 110' forming insulated source of direct current from the mains 102 and a second module 120 or 120' installed near the deflector 104 or 104', for example in a cable trough or path 107. Lines 130 and 130' make it possible to electrically connect the modules 110 and 120 on the one hand, 110' and 120' on the other hand. As before, a direct current transits in the bifilar lines 130 and 130' and the modules 120 and 120' have a function of starter-converter or starter reverser for the lamps 105 and 105'.

The modules 110 and 110' are installed at ground level, in an easily accessible place in the building, which facilitates maintenance thereof. They are associated with a common control unit 140 making it possible to monitor their start up and/or the stop of their functioning.

According to a variant of the invention (not shown), a control module of the type of unit 140 may be associated with each module 110, 110' or equivalent.

Lines 30, 30', 130 and 130' convey a current of relatively low intensity, under a relatively low voltage. They may be constituted by small-section cables, for example of 1.5 $mm^2$ or of 2.5 $mm^2$. These cables, of section less than 4 $mm^2$, are easily positioned inside a post, as in the first embodiment, or in a cable trough or path, as in the second embodiment.

Whatever the embodiment in question, the control modules 40, 40' or 140 may be provided to be capable of receiving information from the or each first module 10, 10', 110 or 110' and of transmitting it to the telemonitoring system. In addition, the exchange of information between the first and third modules 10 and 40 may take place via a wireless link, as indicated with reference to the connector 43 of the first embodiment, an infra-red emitter likewise being able to be associated with a receiver adapted to form this link.

What is claimed is:

1. Supply device for discharge lamps, wherein it comprises, for each lamp:

a first module or current injection circuit comprising, inter alia, a high-frequency inverter delivering a current adapted to ensure stabilization of the discharge in said lamp, a high-frequency transformer providing galvanic insulation of said current with respect to a supply network, then a rectifier and a filter adapted to produce a direct current, a second module or starter-converter circuit, installed near the lamp and adapted to generate, by periodic inversions of the sign of the direct current at the output of the first module or current injection circuit, an alternating current in square-wave form for supplying the lamp, and a bifilar electrical link between the first module and the second module.

2. The device of claim 1, wherein the second module or starter-converter circuit is compatible with lamps of different powers or of different types, while said first module or injection circuit is dedicated to a given power of lamp.

3. The device of claim 1, wherein the device comprises a third module or control circuit adapted to transmit information, particularly orders to start, to stop or to reduce power, to the first module or current injection circuit, as a function of instructions furnished by an outside system, and the exchange of information between the first and third modules takes place via a wireless link, for example via an infra-red system.

4. The device of claim 3, wherein said third module is adapted to receive information from said first module or injection circuit as to the functioning of said lamp and/or said modules and to transmit it to an outside system.

5. The device of claim 1, wherein said lamp and said second module or starter-converter circuit are installed in or in the immediate proximity of the lantern of a lamp post while said first module or injection circuit is installed at the foot of said lamp post.

6. The device of claim 1, wherein said lamp is installed in a deflector close to the ceiling of a building, said second module or starter-converter circuit being housed in the immediate proximity of said deflector, in particular in a trough or in a path for cables supplying said lamp, while said first module or supply circuit is installed at ground level, in an easily accessible place.

7. The device of claim 1, wherein said first module or injection circuit comprises, inter alia, a first rectifier of the mains current associated with a power factor corrector and supplying said high-frequency inverter.

8. The device of claim 1, wherein said second module or starter-converter circuit comprises four power transistors in a full bridge configuration and associated with an electronic control unit for starting and supplying said lamp with alternating current.

9. The device of claim 1, wherein said second module or starter-converter circuit comprises a high-voltage transformer intended for starting said lamp.

* * * * *